US006290179B1

(12) United States Patent
Kerns

(10) Patent No.: US 6,290,179 B1
(45) Date of Patent: Sep. 18, 2001

(54) AIRPLANE KITES AND METHOD

(76) Inventor: Alfred P. Kerns, 331 F St., Martinez, CA (US) 94553

( * ) Notice: Subject to any disclaimer, the term of this patent is extended or adjusted under 35 U.S.C. 154(b) by 0 days.

(21) Appl. No.: 09/187,553

(22) Filed: Nov. 5, 1998

Related U.S. Application Data

(60) Provisional application No. 60/064,548, filed on Nov. 5, 1997.

(51) Int. Cl.[7] ..... B64C 31/06
(52) U.S. Cl. ..... 244/154
(58) Field of Search ..... 244/153 R, 154, 244/155 R

(56) References Cited

U.S. PATENT DOCUMENTS

| | | | | |
|---|---|---|---|---|
| 2,035,730 | * | 3/1936 | Trevor | 244/154 |
| 2,593,979 | | 4/1952 | Calhoun . | |
| 2,744,702 | | 5/1956 | Briggs | 244/154 |
| 2,750,136 | | 6/1956 | Stracke, Jr. | 244/155 |
| 2,778,154 | | 1/1957 | Dauwe . | |
| 2,779,553 | | 1/1957 | Troxell | 244/3 |
| 3,076,626 | | 2/1963 | Andrews | 244/154 |
| 3,107,888 | * | 10/1963 | Finn | 244/154 |
| 3,366,354 | | 1/1968 | Sterba | 244/154 |
| 3,758,057 | | 9/1973 | Stratton | 244/154 |
| 3,912,204 | | 10/1975 | Wheat et al. | 244/154 |
| 4,119,283 | | 10/1978 | De Yarman | 244/153 |
| 4,168,816 | | 9/1979 | Acosta | 244/154 |
| 4,781,344 | | 11/1988 | Thomas | 244/154 |
| 5,076,516 | | 12/1991 | Wheat et al. | 244/154 |

* cited by examiner

*Primary Examiner*—Robert P. Swiatek
(74) *Attorney, Agent, or Firm*—Head, Johnson & Kachigian

(57) ABSTRACT

A scale model airplane kite made of STYROFOAM, an expanded rigid polystyrene plastic foam, and having reinforcing members, rods, dowels, pegs, pins, skewers, or the like embedded in the foam at stress points and oriented to counteract stress forces. These kites are lightweight and can withstand a 15 mph wind. The kites are easy to repair by using more pegs and glue at the fracture site. These kites have string attachment or tether holes reinforced with a plastic tube and balsa wood to prevent the string from coming through the foam and allow the flyer to adjust for different wind velocities. In accordance with one embodiment, the kite is formed of half-inch thick bead foam which is substantially rectangular in cross-section and is cut in elevation and plan view to scale of an actual airplane or aircraft such as a P-40, Zero, P-38, ME-109, FW190, DRI Folker triplane, and the like. Also, the foam may be painted and plastic tails may be added to enhance the aesthetics thereof.

7 Claims, 10 Drawing Sheets

AIRPLANE KITES AND METHOD

CROSS-REFERENCE TO RELATED APPLICATIONS

This application claims the benefit of U.S. provisional application Serial No. 60/064,548, filed Nov. 5, 1997.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention relates to kites and methods of repairing kites and more particularly to scale model airplane kites, and more specifically, the kites in this invention are made of reinforced STYROFOAM, an expanded rigid polystyrene plastic foam material, are easy to repair, and are a substantially to-scale representation of the silhouette of the actual airplanes.

The making of kites in various shapes is well known and is disclosed, for example in U.S. Pat. No. 5,076,516 issued to Wheat et al., U.S. Pat. No. 4,781,344 issued to Thomas, U.S. Pat. No. 4,168,816 issued to Acosta, U.S. Pat. No. 4,119,283 issued to DeYarman, U.S. Pat. No. 3,912,204 issued to Wheat et al., U.S. Pat. No. 3,758,057 issued to Stratton, U.S. Pat. No. 3,366,354 issued to Sterba, U.S. Pat. No. 3,076,626 issued to Andrews, U.S. Pat. No. 2,779,553 issued to Troxell, U.S. Pat. No. 2,778,154 issued to Dauwe, U.S. Pat. No. 2,593,979 issued to Calhoun, U.S. Pat. No. 2,750,136 issued to Stracke, Jr., and U.S. Pat. No. 2,744,702 issued to Briggs.

More particularly, Wheat et al., U.S. Pat. No. 3,912,204, and Wheat et al., U.S. Pat. No. 5,076,516, disclose captive airfoil apparatus. The Wheat '204 patent discloses a captive airfoil preferably of a high lift, high drag design such as a vintage aircraft of the 1910–1930 era. The captive airfoil is tethered by two tether lines each attached to one of the wings at a point near the outer end thereof and spaced relative to one another at about 60–90 degrees. By tethering the airfoil in this manner, the need for a stabilizing kite tail is eliminated. The Wheat '516 patent discloses a method for using a high lift, high drag airfoil on both the lifting wings and the horizontal stabilizer of an airfoil in order to increase the stability of the aircraft at low airspeeds without the use of a stabilizing kite tail. This allows for the airfoil to be flown with a single tether line attached to the nose of the aircraft.

Thomas, U.S. Pat. No. 4,781,344, discloses an airplane kite shaped to generally resemble a jet powered airplane, formed of a lightweight plastic foam material, having a fuselage and vertical stabilizer shaped to resemble the side view of a jet airplane, and a wing and horizontal stabilizer shaped to represent the swept back wings of a jet airplane. The Thomas '344 kite is not a scale representation of an actual airplane because the horizontal and vertical stabilizers are enlarged relative to the normal dimensions of actual jet powered aircraft and the stabilizers and wing are repositioned from that of the original aircraft to provide lift and flight stability when flown from a tether line attached behind the wings of the kite.

Sterba, U.S. Pat. No. 3,366,354, discloses a non-scale toy airplane or glider made of balsa wood and including a U-shaped metal or plastic bracket with laterally projecting lugs on the upper ends of the bracket, an elongated lengthwise wing receiving slot, a spring wire bale for attaching a tether, adhesive tape for joining the wings and elevators, and a transparent plastic canopy. The bracket is used as a weight to stabilize the toy airplane and to provide a mounting area for the tether line.

Andrews, U.S. Pat. No. 3,076,626, Dauwe, U.S. Pat. No. 2,778,154, Acosta, U.S. Pat. No. 4,168,816, and Stratton, U.S. Pat. No. 3,758,057, disclose airplane kites or gliders including a skeletal frame or support frame covered at least in part by a lightweight, flexible sheet material such as paper or plastic. Andrews '626 is directed to a generally plane shaped traditional kite resembling but not modeling a swept wing aeroplane. Dauwe '154 is directed to a captive glider with a hingible wing connection to vary the direction of the flight. The Acosta '916 kite includes an arrow shaped body formed of styrene or air-inflated fuselage-shaped plastic cushion. Stratton '057 is directed to a non-scale kite designed to resemble a Nieuport biplane of World War I.

Briggs, U.S. Pat. No. 2,744,702, discloses a Pegasus shaped kite having a fuselage including a reinforcing wire. This wire is bent to extend throughout the fuselage and includes a loop for attaching the kite to a string or tethering line.

Calhoun, U.S. Pat. No. 2,593,979, discloses a tethered toy in the general shape of an airplane which has a plastic fuselage covered with a silver coating and a wing which rotates about a wire strut support.

Although prior art patents disclose various forms of kites, there exists the need for a flyable scale model airplane kite representing the horizontal and vertical silhouette of actual airplanes, which is easy to fly, sturdy in construction, and easily repairable, an inexpensive scale model kite with realistic markings, a kite which is easily repaired, a kite with reinforcing members, rods, dowels, pegs, pins, or skewers at stress points, a kite with a variable tether attachment point to adapt for varying wind conditions, and an improved airplane kite which is of scale form and is sufficiently rigid to withstand the normal wear and tear associated with the flying of kites in low to high wind conditions.

BRIEF SUMMARY OF THE INVENTION

In accordance with the present invention, there is provided a flyable scale model kite representing the horizontal and vertical silhouette of an actual airplane, which is easy to fly, sturdy in construction, and easily repairable. Because it is more enjoyable to fly an actual scale rendition of a real airplane, there is provided an inexpensive scale model kite with realistic markings. Because airplane kites can be damaged when the kite crashes into another kite, the ground or other object, there is provided a kite which is easily repaired. Because kites flown in high winds are subjected to high stress forces, there is provided a kite with reinforcing members, rods, dowels, pegs, pins, or skewers at stress points. Furthermore, due to the variations in wind conditions on any particular day, there is provided a kite with a variable tether attachment point to adapt for the varying wind conditions. Also, there is provided an improved airplane kite which is of scale form and is sufficiently rigid to withstand the normal wear and tear associated with the flying of kites in low to high wind conditions.

In accordance with the present invention, a new and improved scale model airplane kite is made of STYROFOAM, an expanded rigid polystyrene plastic foam, and has reinforcing members, rods, dowels, pegs, pins, skewers, or the like embedded in the foam at stress points and oriented to counteract stress forces. These kites are lightweight and can withstand a 15 mph wind. The kites are easy to repair by using more pegs and glue at the fracture site. The multiple tether attachment holes are reinforced with a plastic tube and balsa wood to prevent the string from coming through the foam and allow the flyer to adjust for different wind velocities. In accordance with one embodiment, the kite is formed of half-inch thick bead foam which is either substantially rectangular in cross-section, or the shape of an airfoil, and is cut in plan view to represent a scale rendition of an actual airplane such as a P-40, Zero, P-38, ME-109, FW190, Folker triplane, or the like. Also, the foam may be painted and plastic tails may be added to enhance the aesthetics thereof.

A principle object of the present invention is the provision of an airplane kite.

Another object of the present invention is a method of repairing an airplane kite.

Still another object of the present invention is the provision of an improved airplane kite and method.

Yet another object of the present invention is the provision of a flyable scale model airplane kite representing the horizontal and vertical silhouette of actual airplanes.

Another object of the present invention is the provision of a flyable scale model airplane kite which is easy to fly, sturdy in construction, easily repaired, relatively inexpensive, and can be flown in varying wind conditions.

Still yet another object of the present invention is the provision of a flyable scale model airplane kite with reinforcing members, rods, dowels, pegs, pins, or skewers at stress points.

A more particular object of the present invention is the provision of a kite with a variable tether attachment point adapted for varying wind conditions.

Other objects and further scope of the applicability of the present invention will become apparent from the detailed description to follow, taken in conjunction with the accompanying drawings, wherein like parts are designated by like reference numerals.

DETAILED DESCRIPTION OF THE INVENTION

In accordance with the present invention, a new and improved scale model airplane kite is made of STYROFOAM, an expanded rigid polystyrene plastic foam, or a similar material and has reinforcing members, rods, dowels, pegs, pins, skewers, or the like embedded in the foam, especially at stress points. These reinforcing rods and dowels are oriented to counteract the normal stress forces applied during the flying of the kite. These kites are lightweight and can withstand a 15 mph wind. The kites are easy to repair by using more pegs and glue at the fracture site. The string attachment holes are reinforced with a plastic tube and balsa wood to prevent the string from coming through the styrofoam and allow the flyer to adjust for different wind velocities.

In accordance with one embodiment, the kite is formed of one quarter to one-half inch thick bead foam which is substantially rectangular in cross-section and is cut in elevation and plan view to scale of an actual airplane such as a P-40, Zero, P-38, ME-109, FW190, DRI Folker triplane, Spitfire, and the like. Also, the foam may be painted and plastic tails may be added to enhance the aesthetics thereof.

Figure 1:
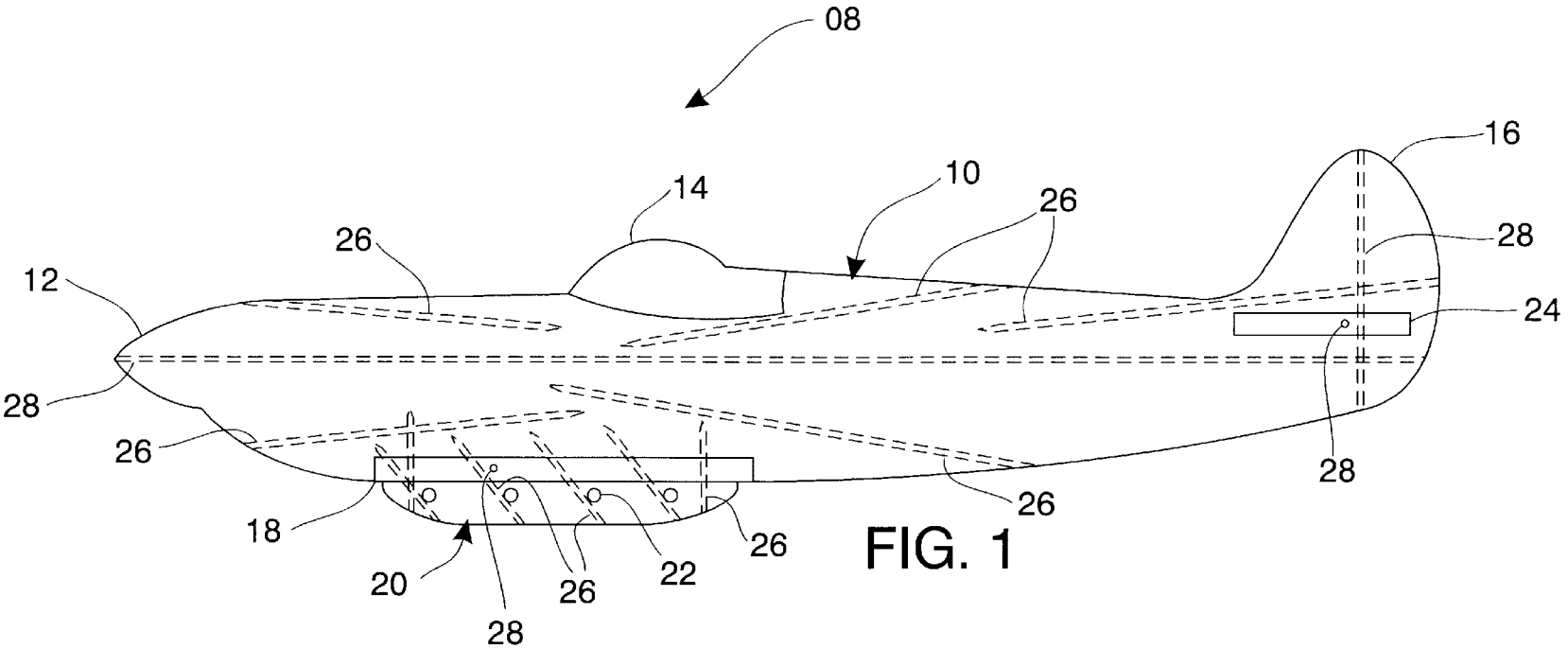
FIG. 1 is a side elevational view of an airplane kite of the present invention representing a Spitfire aircraft.

FIG. 1 shows a side elevational view of an airplane kite (08) and its body or fuselage (10) representing a Spitfire. The airplane kite body (10) includes a nose section (12), canopy area (14) and tail section (16) in proportion to the actual Spitfire airplane being modeled. The kite has a wing section (18) attached to a recess (19) in the body (10) positioned and sized in relation to the actual airplane being modeled. The kite wing (18) can have a rectangular cross section as shown, or can be made in an airfoil shape (FIG. 9) and in one example is made in a scale such that the length of the wings is approximately 28 inches when measured from tip to tip. The airfoil shape is not generally recommended unless the wing member is greater than one inch in horizontal thickness for the scale rendition of the actual airplane.

A tether attachment area (20) is positioned below the wing section (18) and is attached to the kite body (10) to allow for different flying characteristics of the aircraft for various wind conditions. Tether attachment holes (22) extend through the tether attachment area (20). A horizontal stabilizer section (24) is also attached to the kite body (10) in a recess or opening (27) positioned in accordance with the full scale airplane being modeled. Reinforcing rods (26) are inserted into the body (10), wing (18), tether attachment area (20) and horizontal stabilizer (24) to reinforce these parts and increase the strength of the airplane kite (08). Unless otherwise noted, all of the attachments between parts are secured with an appropriate glue, and may be reinforced with reinforcing rods (26) or dowels (28). Reinforcing dowels (28) act much like the reinforcing rods (26) and the dowels (28) can be inserted through the entire length of the body (10), wing (18), tail section (16), and horizontal stabilizer (24) to add strength along the entire length of these structures. The reinforcing rods (26) and dowels (28) are also used to reinforce the attachment areas between pieces of the airplane kite such as the body (10) to wing (18), body (10) to horizontal stabilizer (24) and body (10) to tether attachment area (20). These reinforcing rods (26) and dowels (28) can be inserted in either a perpendicular or angular manner in relation to the pieces being attached together (FIGS. 1–5).

Figure 2:
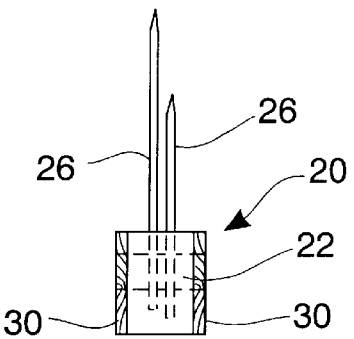
FIG. 2 is an enlarged front elevational view of the tether attachment area of the airplane kite of FIG. 1.

FIG. 2 shows a view of the front of the tether attachment area (20). The tether attachment area (20) is strengthened by reinforcing layers (30), made of balsa wood or other suitable materials which may be attached to each side of the foam center of the tether attachment area (20). This reinforcing layers (30) add strength to the tether attachment holes (22) by reinforcing the outside edges of the attachment holes (22). Furthermore, multiple reinforcing rods (26) are used to reinforce this area and attach the tether attachment area (20) to the wing (18) and body (10). At least some of the reinforcing rods (26) or dowels (28) are placed in an offset position from the vertical central axis of the tether attachment area (20) to counter the forces on the tether attachment and allow for multiple reinforcing rods (26) to be used to secure and strengthen the tether attachment area (20).

Figure 3:
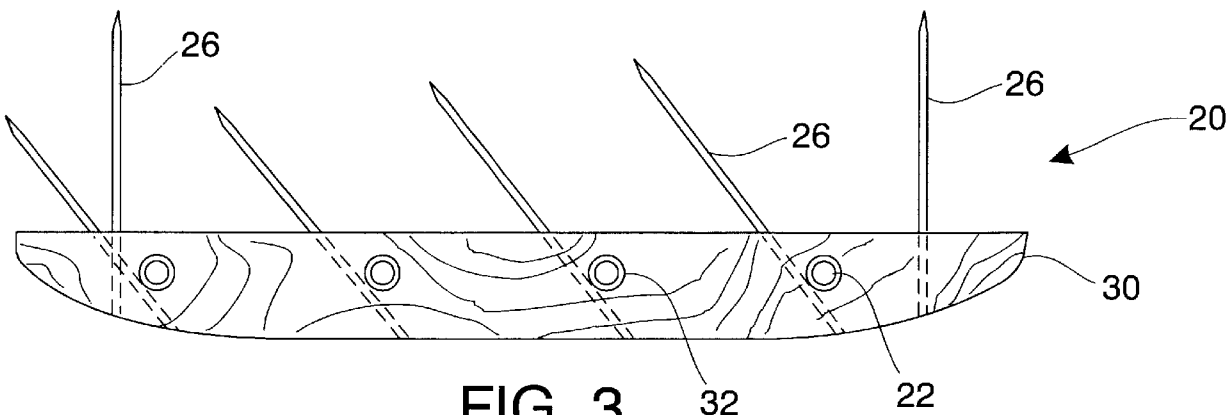
FIG. 3 is an enlarged side elevational view of the tether attachment area of the airplane kite of FIG. 1.

FIG. 3 shows a side view of the tether attachment area (20) with the added reinforcing layer (30), attachment holes (22) and reinforcing rods (26). Each of the tether attachment holes (22) are reinforced with a layer of plastic tubing (32). By utilizing a soft material for the tubing (32), or a tubing (32) with smooth edges, a tethering hole (22) may be built which does not cut or separate the strands of the tethering line. The attachment holes (22) are further strengthened by inserting reinforcing rods (26) or dowels (28) next to the tether attachment holes(22). The rods (26) or dowels (28) may be inserted at an angle which is substantially perpendicular to the force that is to be asserted by a tether line through the holes (22), reinforcing tubing (32) and reinforcing layer (30) to the tether attachment area (20) to maximize the strength of the holes (22). This force-perpendicular insertion of the reinforcing rods (26) or dowels (28) is also designed to maximize the strength of the attachment between the wing (18), body (10) and the tether attachment area (20).

Figure 4:
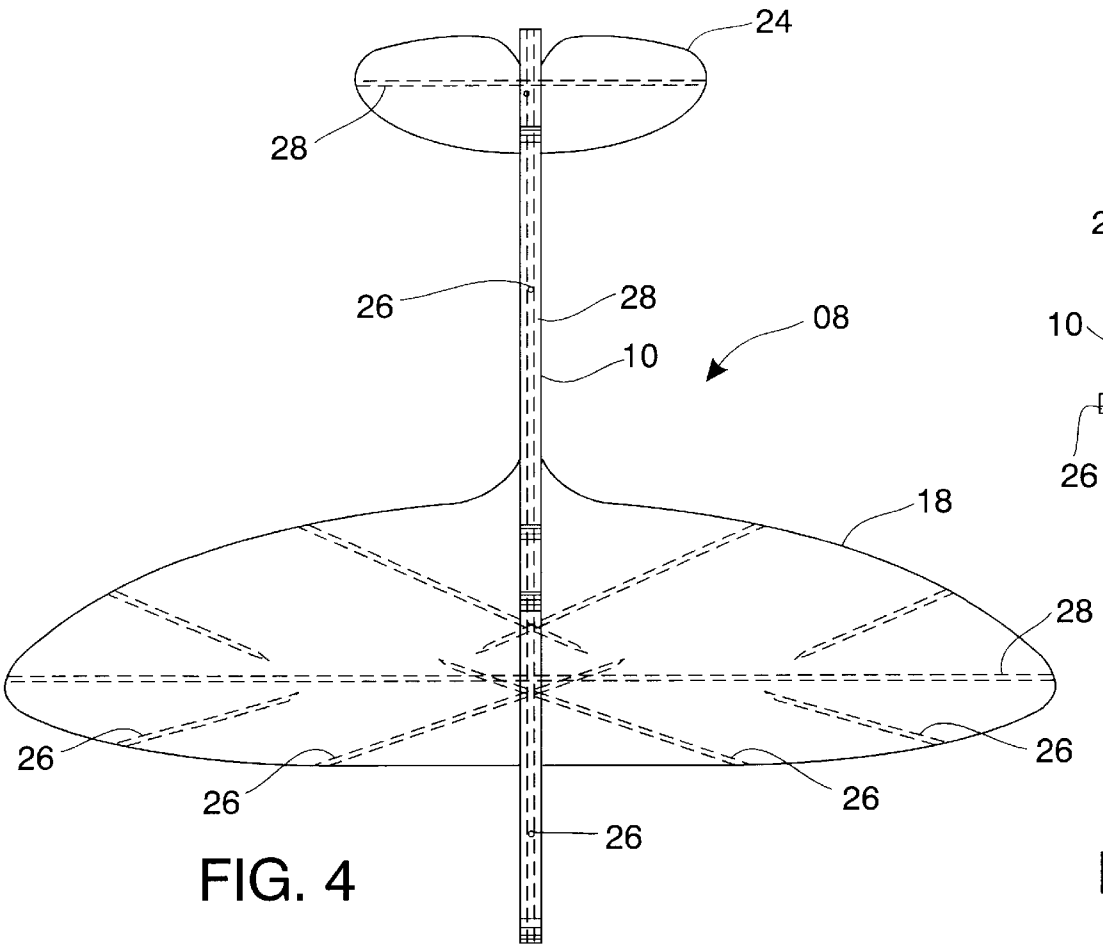
FIG. 4 is a top plan view of the airplane kite of FIG. 1.

FIG. 4 shows a view of the top of the body (10), wing (18), and horizontal stabilizer (24) of the airplane kite (08). The inserted reinforcing rods (26) and dowels (28) can be seen in the wing area and, if necessary, additional reinforcing rods (26) could also be inserted in the horizontal stabilizer (24). Reinforcing dowels (28) which extend the entire length of the body (10), wing (18) and the horizontal stabilizer (24) are also depicted. Note the crossing pattern of the reinforcing rods (26) through the wing (18) and the wing (18) to body (10) attachment area. This same type of pattern may be used where the horizontal stabilizer (24) is attached to the body (10). Alternatively, this cross pattern may be formed by using reinforcing dowels (28). See FIG. 11 for a depiction of the use of reinforcing dowels (28C) in the wing (18C) to body (10C) attachment area.

Figure 5:
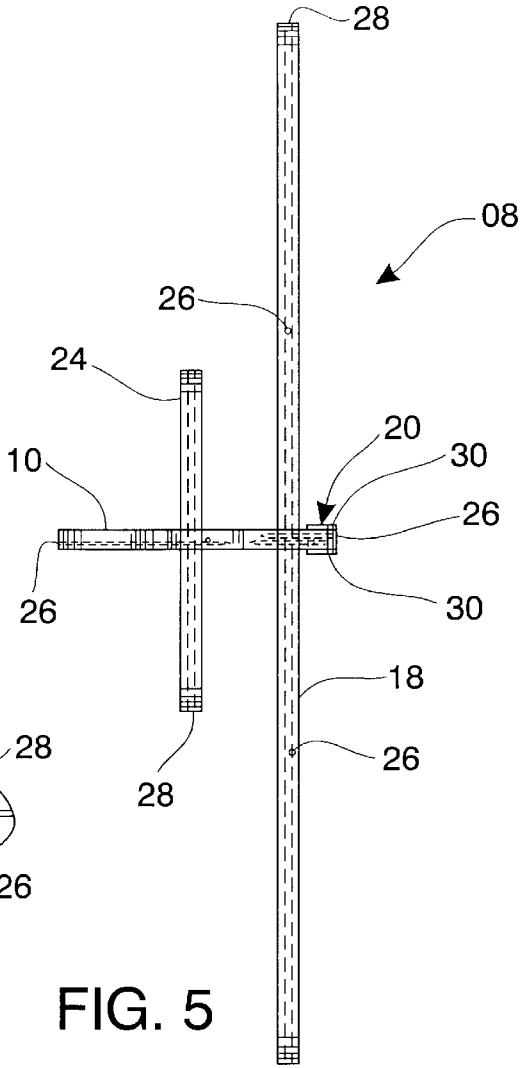
FIG. 5 is a rear elevational view of the airplane kite of FIG. 1.

FIG. 5 shows an elevational view of the front of the airplane kite (08), body (10), wing (18), horizontal stabilizer (24), and tether attachment area (20). Reinforcing rods (26) and dowels (28) can be seen at various insertion points in each of the different parts of the airplane kite (08), as well as the reinforcing layers (30) on the tether attachment area (20).

Figure 6:
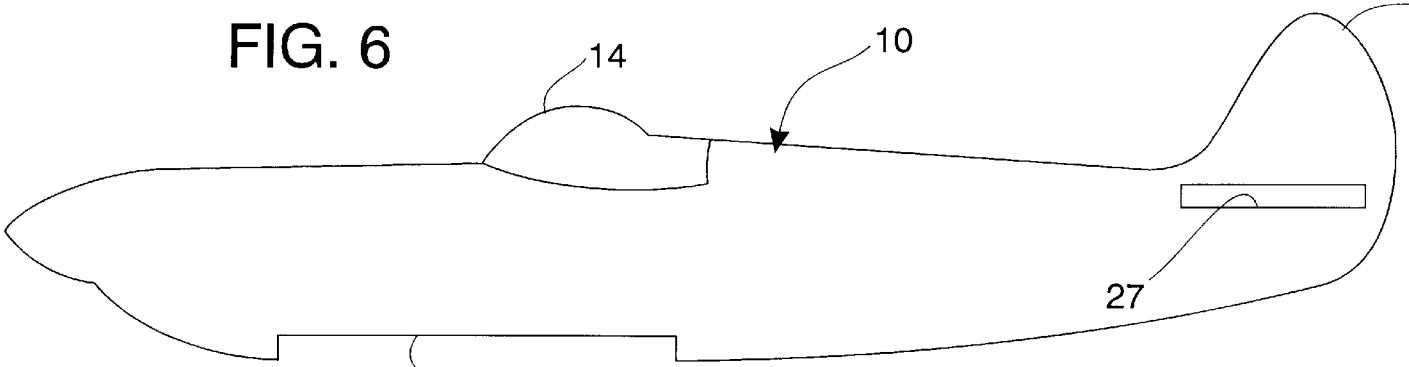
FIG. 6 is a side view of the fuselage of the airplane kite of FIG. 1.
Figure 8:
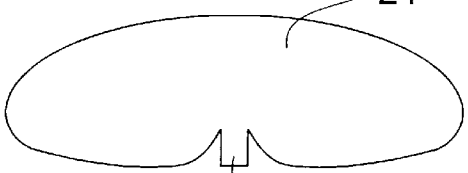
FIG. 8 is a top view of the stabilizer section of the airplane kite of FIG. 1.
Figure 7:
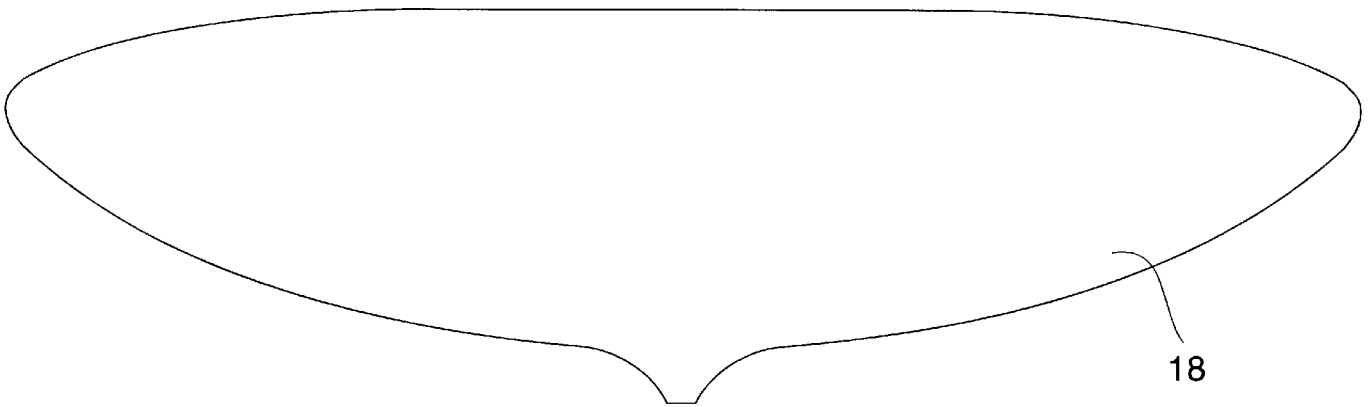
FIG. 7 is a top view of the wing section of the airplane kite of FIG. 1.

With reference to FIGS. 6–8 of the drawings, the wing section (18) is a single piece which is glued and pinned in rectangular recess (19) in the bottom of airplane body (10). The stabilizer (24) is a single piece having a tab (25) and which is glued and pinned in rectangular opening (27) in the tail of body (10). The tab (25) is adapted to completely fill the receiving opening (27).

Figure 9:
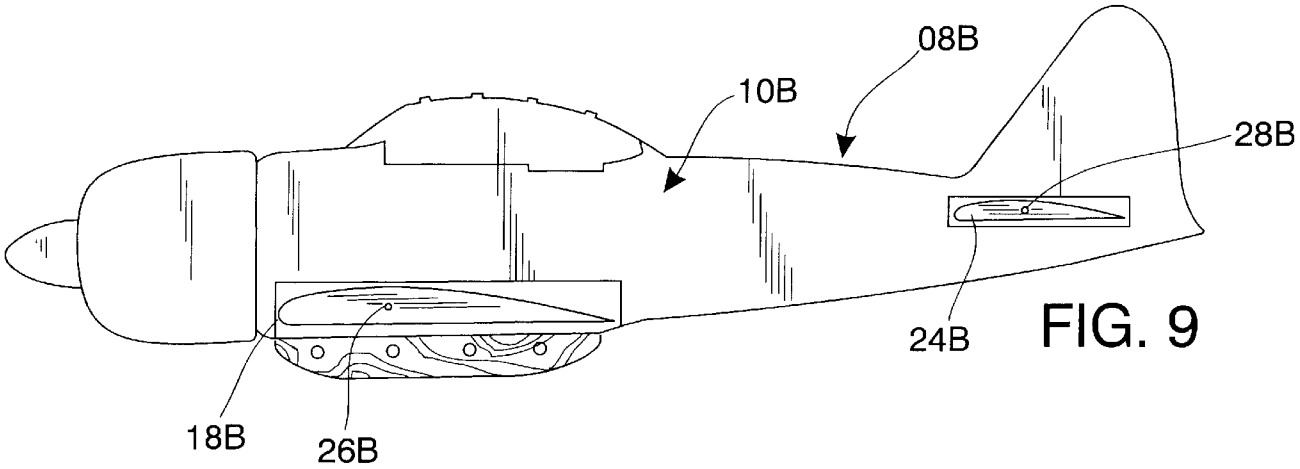
FIG. 9 is a side elevational view of another airplane kite of the present invention representing a Zero.

FIG. 9 shows a side elevational view of an airplane kite (08B) modeled to represent a World War II Japanese Zero airplane. Note that only the ends of the reinforcing rods (26B) or dowels (28B) are visible in the final embodiment of the airplane kite (08B). An airfoil shaped wing (18B) and horizontal stabilizer (24B) have been used on this embodiment. Like the fuselage (10) of kite (08) of FIGS. 1–8, the fuselage (10B) of kite (8B) has rectangular openings for receiving the wing (18B) and stabilizer (24B). Hence, the wing (18B) and stabilizer (24B) each have a rectangular central portion adapted to fill the receiving recess or opening while the remainder of the wing and stabilizer have an airfoil shape.

Figure 10:
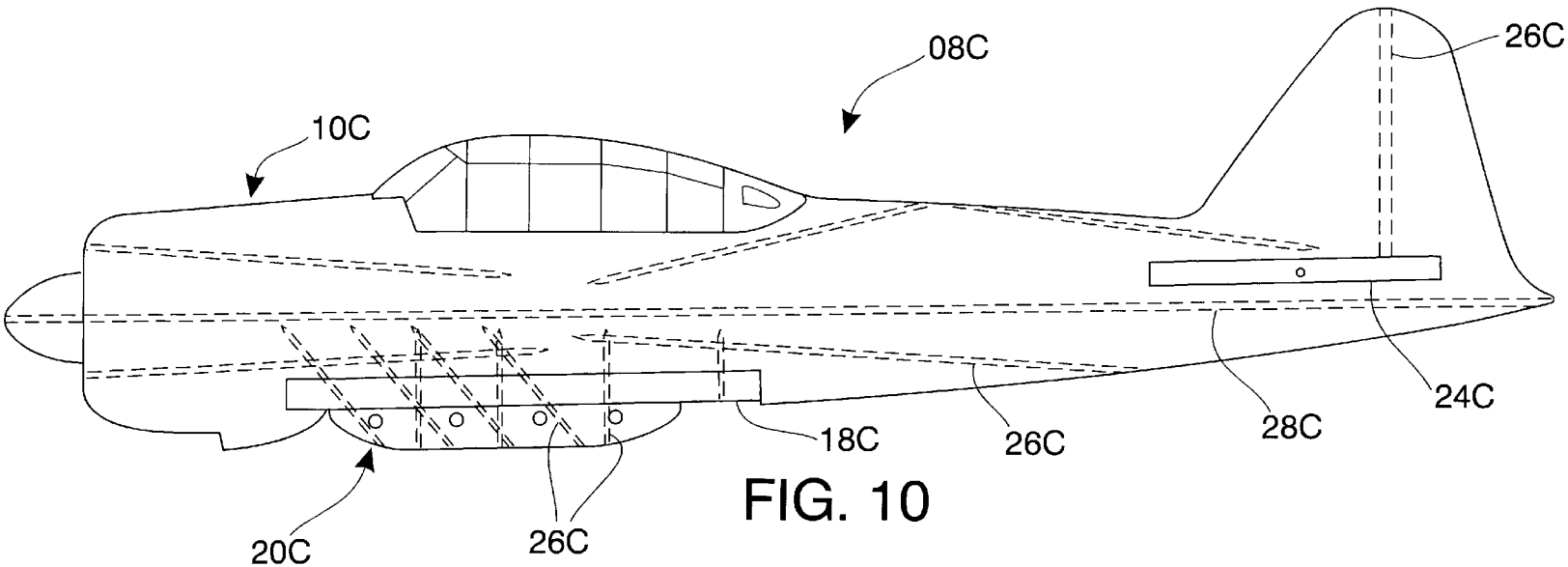
FIG. 10 is a side elevational view of still another airplane kite of the present invention representing a Zero.

FIG. 10 is a side elevational view of another airplane kite (08C) representing a Japanese Zero aircraft. The Zero kite (08C) of FIGS. 10 and 11 differs from the kite (08B) of FIG. 9 in that the wing (18C) and stabilizer (24C) have a rectangular rather than airfoil cross-section.

Figure 11:
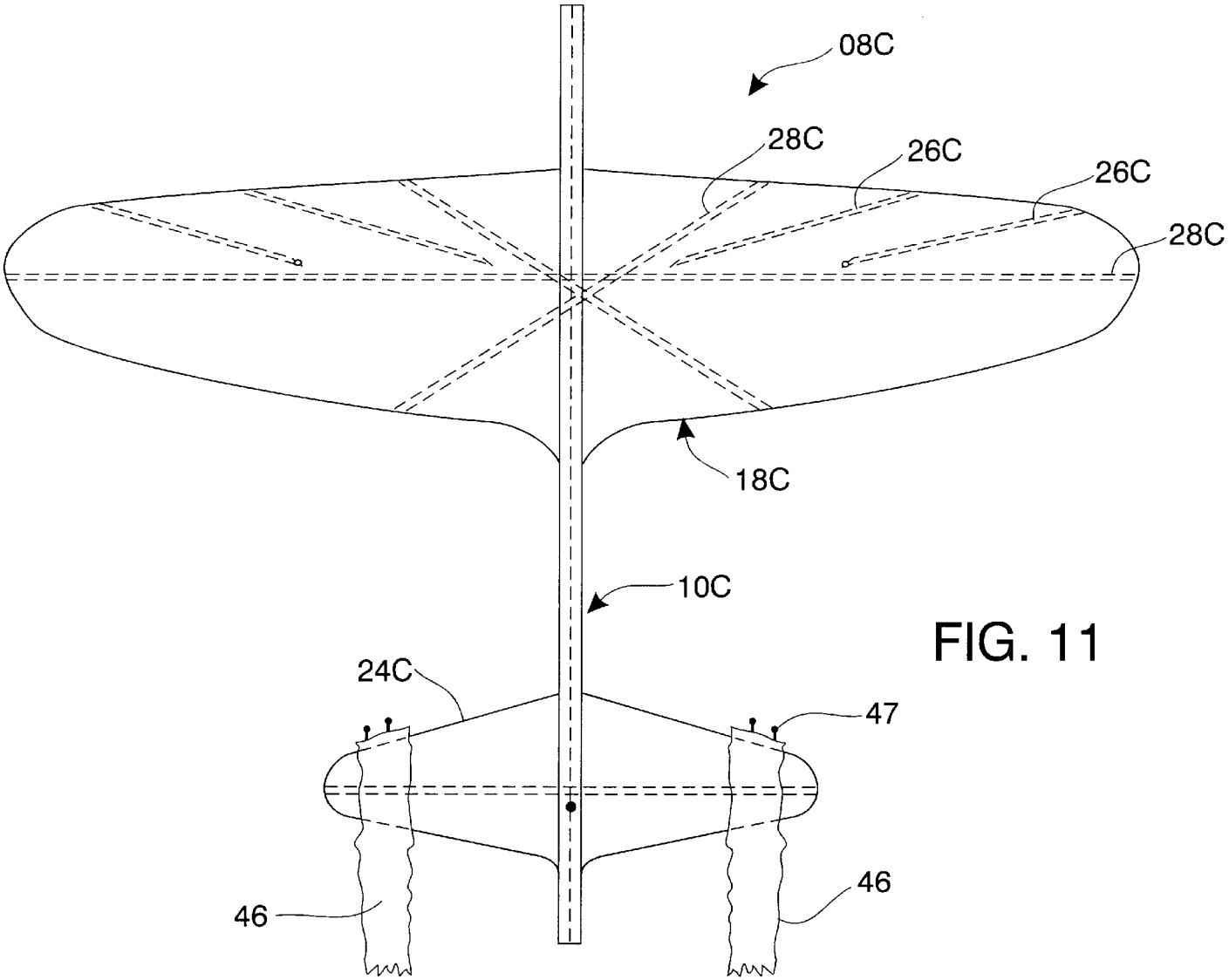
FIG. 11 is a top plan view of the airplane kite of FIG. 10 with two attached tails.

FIG. 11 shows the use of multiple tails (46) attached by pins (47) to the stabilizer (24C) of the Zero airplane kite (08C). Tails for the airplane kite become necessary when the wind speed exceeds approximately 15 mph. This figure also discloses the use of multiple reinforcing dowels (28C) being used in a crossing pattern where the wing (18C) is joined to the aircraft body (10C) and to reinforce this attachment area.

Figure 12:
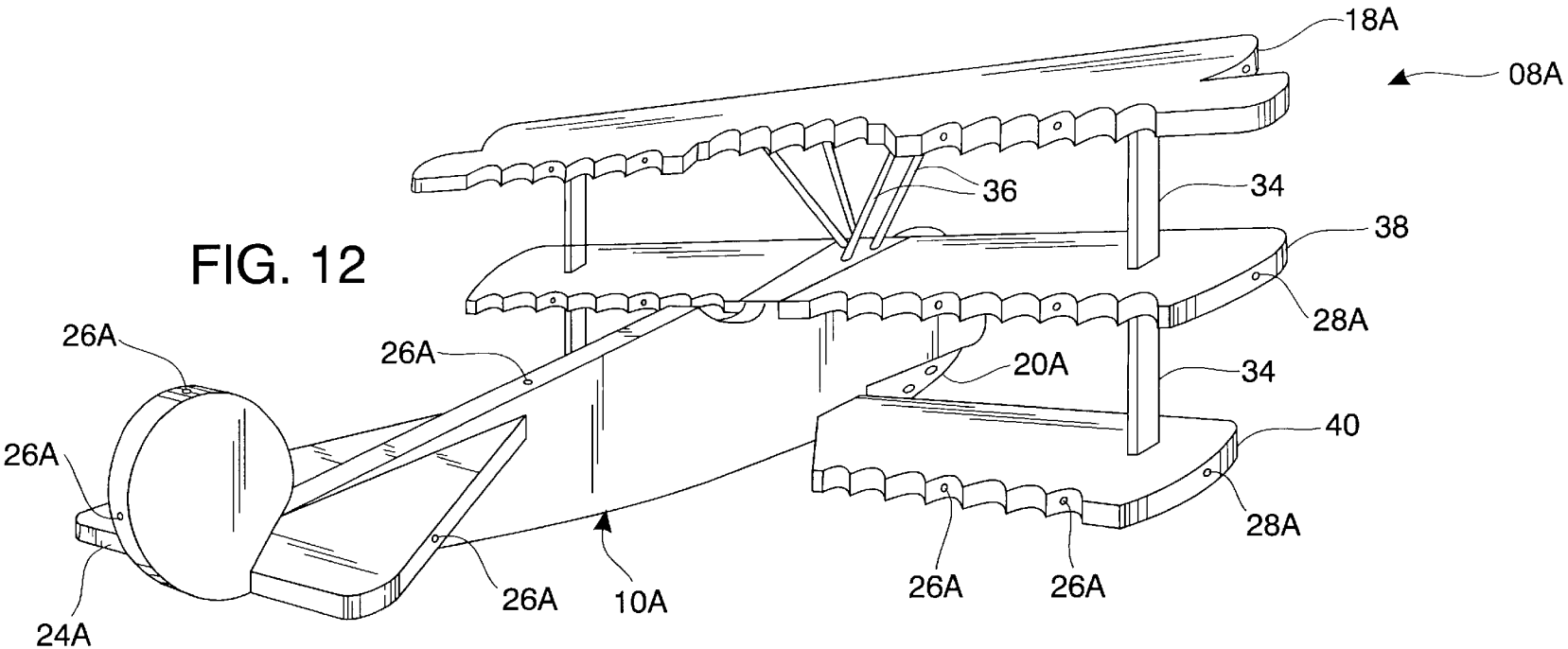
FIG. 12 is a perspective view of a tri-wing airplane kite of the present invention representing a DRI.

FIG. 12 shows a perspective view of another embodiment of an airplane kite (08A) with body (10A), first top wing (18A), second middle wing (38), third bottom wing (40), internal struts (36), external struts (34), horizontal stabilizer (24A), and tether attachment area (20A) representing a DRI Folker triplane. Note the insertion of the reinforcing rods (26A) and dowels (28A) throughout the structure. The internal wing struts (36) may be constructed by inserting a reinforcing rod or dowel (26A or 28A) between the first top wing (18A) and body (10A) at an angle appropriate to the aircraft being modeled. The external wing struts (34) may be constructed by inserting a reinforcing dowel (26A) which extends from first top wing (18A) through the second middle wing (38) to the third bottom wing (40). Alternatively, the internal (36) or external (34) wing struts may be enhanced by attaching an additional piece of balsa or foam to the strut to enhance its overall appearance. This is discussed in further detail in the discussion of FIGS. 13–18.

Figure 13:
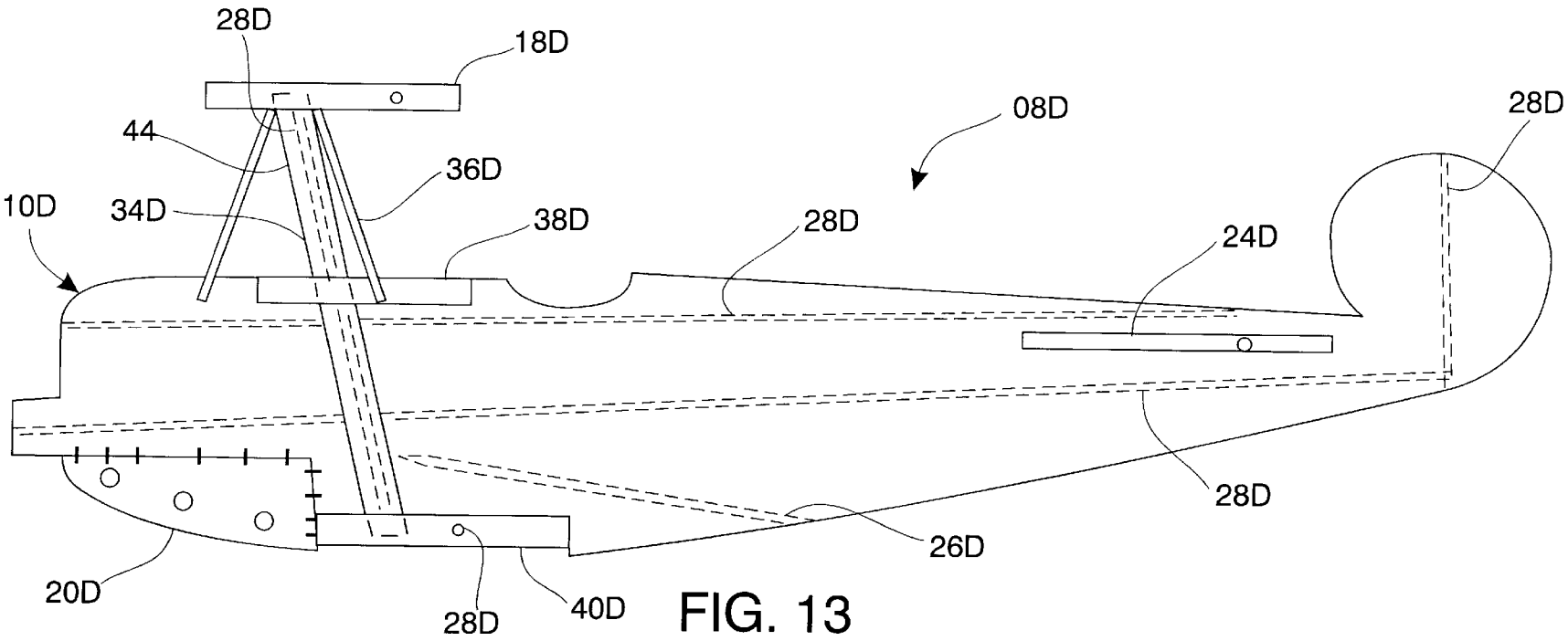
FIG. 13 is a side elevational view of a tri-wing airplane kite representing a DRI.

FIG. 13 is a side elevational schematic of another airplane kite (08D) representing a World War I DRI Folker triplane or tri-wing aircraft. Note that the tether attachment area (20D) has been moved forward on the aircraft body (10D) due to the different flying characteristics of this aircraft.

Figure 14:
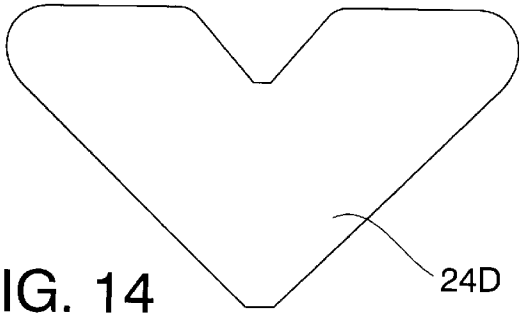
FIG. 14 is a top view of the stabilizer section of the airplane kite of FIG. 13.

FIG. 14 shows the stabilizer (24D) which is fitted into a rectangular opening in the body (10D) and glued and pinned into position.

Figure 15:
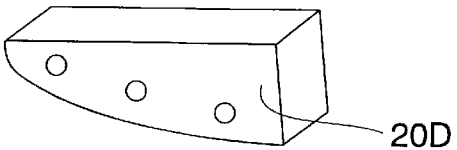
FIG. 15 is a perspective view of the tether attachment area of the airplane kite of FIG. 13.

FIG. 15 shows the tether attachment structure (20D) which is similar in construction to the tether attachment (20) of FIGS. 1–3, but is shaped to fit in a recess under the nose of the airplane body (10D).

Figure 16:
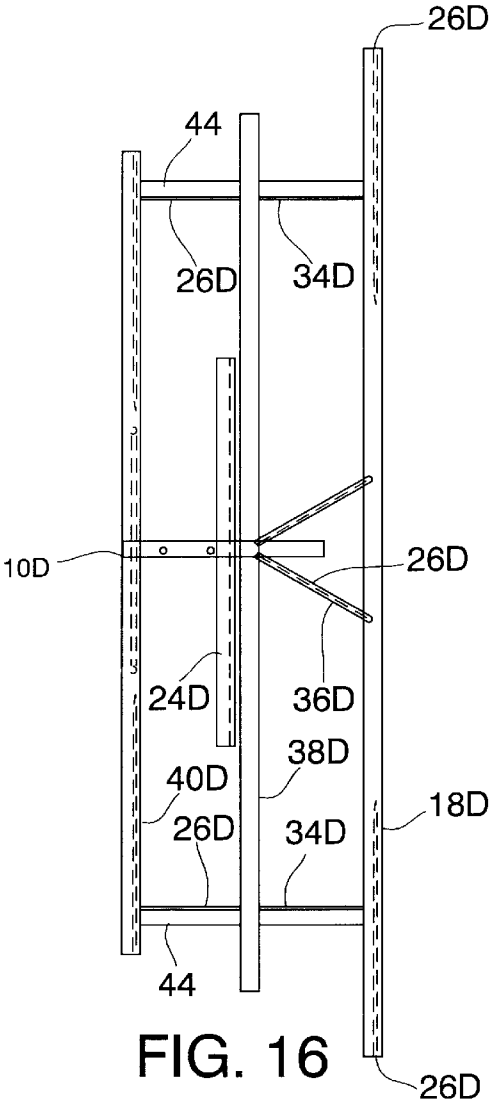
FIG. 16 is a front elevational view of the airplane kite of FIG. 13.

FIG. 16 shows a frontal view of the tri-wing aircraft kite (08D) and the placement of the interior (36D) and exterior (34D) struts. Exterior (34D) and interior (36D) strut assemblies are added to represent the struts of the original aircraft. Either of the interior (36D) or exterior (34D) strut assemblies may be formed from a dowel (28D) or reinforcing rod (26D). The struts (34D) extend from the upper wing (18D) through the middle wing (38D) and into the lower wing (40D). A strut material (44) is added to the dowel (28D) to form the visual appearance of the actual strut of the original aircraft. Note that if the original aircraft had relatively thick struts, the scale model dowel (28D) or rod (26D) may be placed inside the scale model strut material (44). Although it is preferred that each of the wings are formed from a single solid piece of foam, each of the wings may be made from several pieces joined together.

Figure 17:
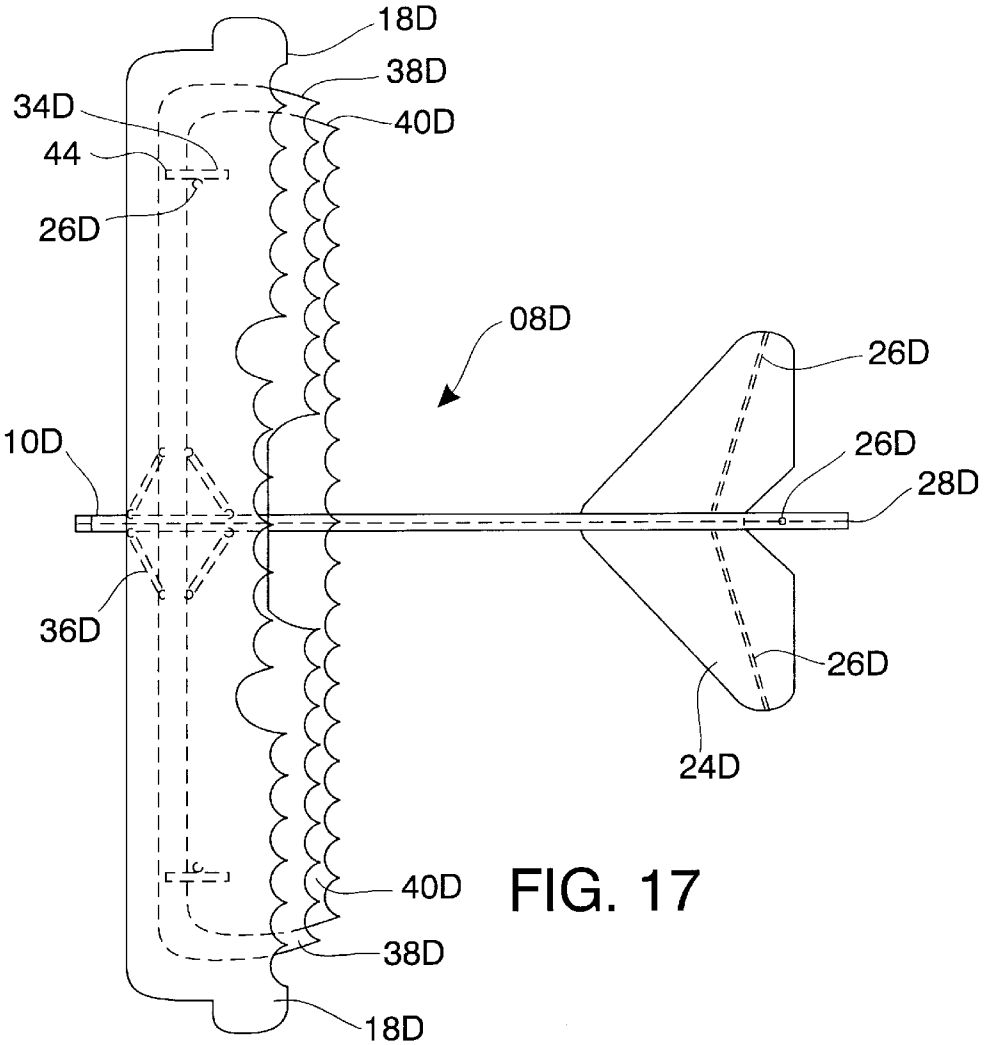
FIG. 17 is a top plan view of the airplane kite of FIG. 13.

FIG. 17 shows a top elevational view of the tri-wing aircraft (08D) with top (18D), middle (38D) and bottom (40D) wings, horizontal stabilizer (24D), body (10D), interior struts (36D), exterior struts (34D), reinforcing rods (26D), and reinforcing dowels (28D).

Figure 18:
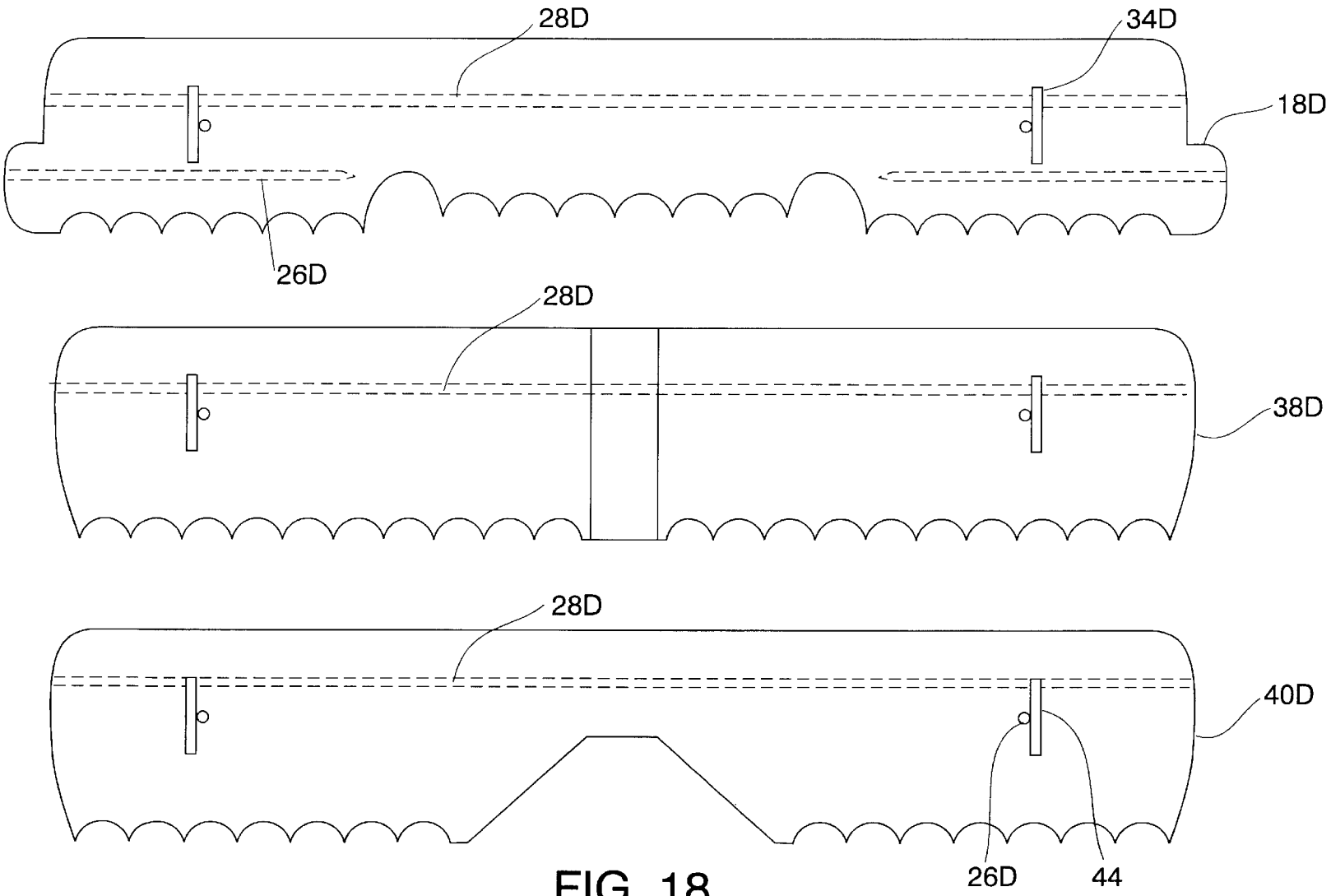
FIG. 18 is a top view of the three wings of the tri-wing airplane kite of FIG. 13.

FIG. 18 shows the various configurations of the top (18D), middle (38D), and lower (40D) wings for the tri-wing aircraft kite (08D). The top wing (18D), second (38D) and third (40D) wings are each formed of a single piece of material. This figure also shows the positioning of the exterior struts (34D) on the top (18D), middle (38D) and bottom (40D) wings.

Figure 19:
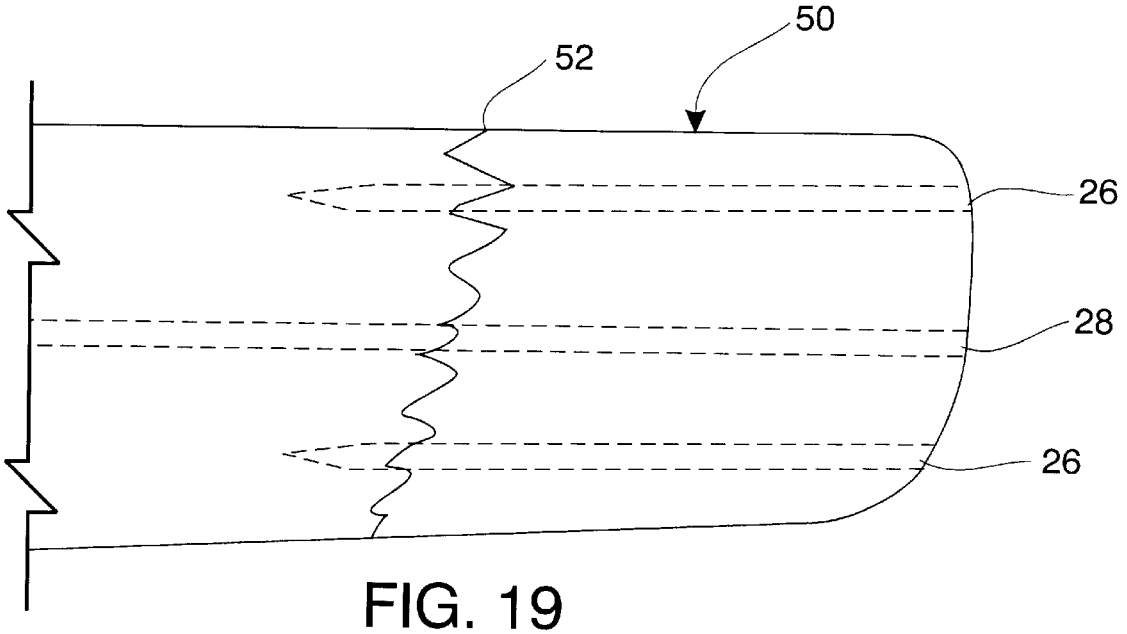
FIG. 19 is a fragmentary top view of a repaired wing.
Figure 20:
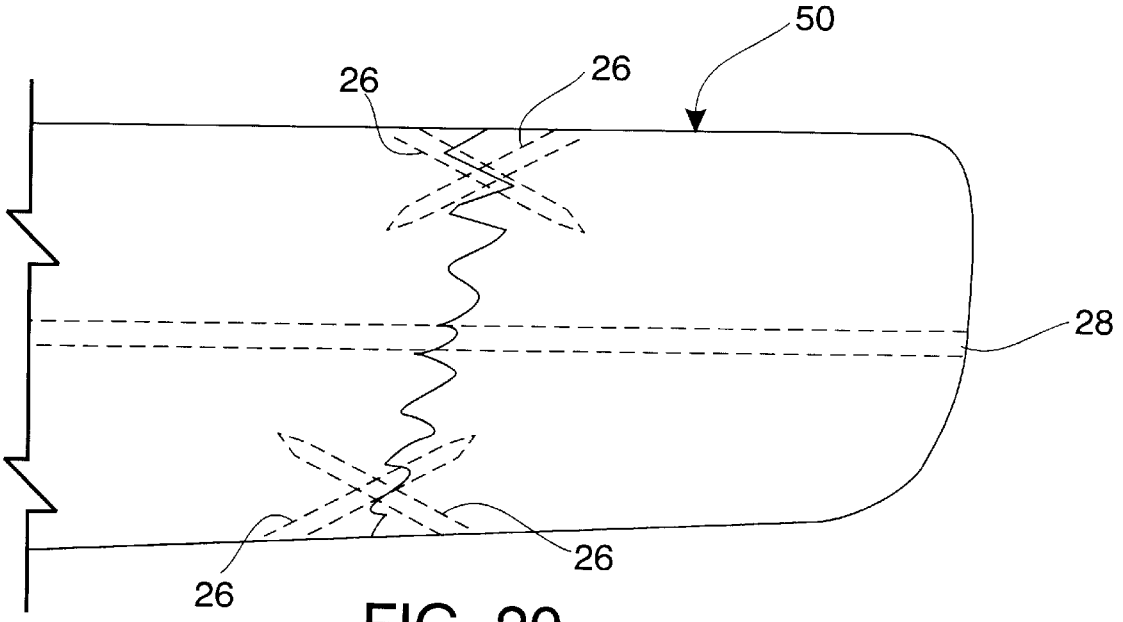
FIG. 20 is a fragmentary top view of another repaired wing.

FIGS. 19 and 20 show a cracked member (50) which represents any of the pieces of the model such as the body (10), wing (18), second wing (38), third wing (40), horizontal stabilizer (24), or the like which may be repaired on the aircraft kite (08). One of the advantages of using a reinforced solid member (50) is that the pieces tend to remain intact after an impact. Usually the solid material will crack, but the reinforcing rods (26) or dowels (28) will hold the pieces together for recovery. Once recovered, the pieces may be repaired by gluing the cracked area (52) back together, and adding additional reinforcing rods (26) or dowels (28). As shown in FIG. 19, reinforcing rods (26) or dowels (28) may be inserted into the member (50) to reinforce the member along its length. FIG. 20 shows an alternative method for inserting reinforcing rods (26) or dowels (28) at a crossing angle to lock the cracked member (50) back together.

Note that the representation of landing gear has been omitted from these models in order to improve crashworthiness of the kites. Thus, the kites are more likely to survive an accident intact. A landing gear may be added if desired.

Whereas, the present invention has been described in relation to the drawings attached hereto, it should be understood that other and further modifications, apart from those shown or suggested herein, may be made within the spirit and scope of this invention.

What is claimed is:

1. An airplane kite, comprising:

at least one wing member, in horizontal plan being a scale representation of at least one wing of a full size aircraft, wherein said at least one wing member includes at least one reinforcing member, and at least one body member operatively attached to said at least one wing member, wherein said at least on body member is constructed in vertical elevation being a scale representation of at least the nose and fuselage of the full size aircraft, said at least one body member has at least one tether attachment area with at least one tether hole positioned for attachment of a tether line, wherein at least one reinforcing member is located directly in front of each said at least one tether hole for additional support from the stresses applied by the tethering line.

2. An airplane kite, comprising:

at least one wing member, in horizontal plan being a scale representation of at least one wing of a full size aircraft, wherein said at least one wing member includes at least one reinforcing member, and at least one body member operatively attached to said at least one wing member, wherein said at least one body member is constructed in vertical elevation being a scale representation of at least the nose and fuselage of the full size aircraft, wherein at least one reinforcing member connects said at least one wing member to said at least one body member and said at least one body member has at least one tether attachment area with at least one tether hole positioned for attachment of a tether line, at least one reinforcing member being located directly in front of each said at least one tether hole for additional support from the stresses applied by the tethering line.

3. An airplane kite, comprising:

at least one wing member, in horizontal plan being a scale representation of at least one wing of a full size aircraft, wherein said at least one wing member includes at least one reinforcing member, at least one body member operatively attached to said at least one wing member, wherein said at least one body member is constructed in vertical elevation being a scale representation of at least the nose and fuselage of the full size aircraft, and at least one tail member operatively connected to said at least one body member, wherein said at least one tail member is constructed in vertical elevation as a scale representation of the tail member of the full sized aircraft wherein at least one reinforcing member connects said at least one tail member and said at least one body member and said at least one body member has at least one tether attachment area with at least one tether hole positioned for attachment of a tether line, at least one reinforcing member being located directly in front of each said at least one tether hole for additional support from the stresses applied by the tethering line.

4. An airplane kite, comprising:

at least one wing member, in horizontal plan being a scale representation of at least one wing of a full size aircraft, wherein said at least one wing member includes at least one reinforcing member, and at least one body member operatively attached to said at least one wing member, wherein said at least one body member is constructed in vertical elevation being a scale representation of at least the nose and fuselage of the full size aircraft, said at least one body member has at least one tether attachment area with at least one tether hole positioned for attachment of a tether line, wherein said at least one body member, at least one wing member and at least one tether attachment area are connected by at least one reinforcing member.

5. An airplane kite, comprising:

at least one wing member, in horizontal plan being a scale representation of at least one wing of a full size aircraft, wherein said at least one wing member includes at least one reinforcing member, at least one body member operatively attached to said at least one wing member, wherein said at least one body member is constructed in vertical elevation being a scale representation of at least the nose and fuselage of the full size aircraft, and a horizontal stabilizer operatively attached to said body member, wherein said horizontal stabilizer is constructed in horizontal plan as a scale representation of the horizontal stabilizer of the full size aircraft, wherein said horizontal stabilizer and said at least one body member are connected by at least one reinforcing member and said at least one body member has at least one tether attachment area with at least one tether hole positioned for attachment of a tether line, at least one reinforcing member being located directly in front of each said at least one tether hole for additional support from the stresses applied by the tethering line.

6. An airplane kite, comprising:

at least one wing member, in horizontal plan being a scale representation of at least one wing of a full size aircraft, wherein said at least one wing member includes at least one reinforcing member, at least one body member operatively attached to said at least one wing member, wherein said at least one body member is constructed in vertical elevation being a scale representation of at least the nose and fuselage of the full size aircraft, at least one tail member operatively connected to said at least one body member, wherein said at least one tail member is constructed in vertical elevation as a scale representation of the tail member of the full sized aircraft, and a horizontal stabilizer operatively attached to said at least one tail member, wherein said horizontal stabilizer is constructed in horizontal plan as a scale representation of the horizontal stabilizer of the full size aircraft, wherein said horizontal stabilizer and said at least one tail member are connected by at least one reinforcing member and said at least one body member has at least one tether attachment area with at least one tether hole positioned for attachment of a tether line, at least one reinforcing member being located directly in front of each said at least one tether hole for additional support from the stresses applied by the tethering line.

7. An airplane kite, comprising:

at least one wing member, in horizontal plan being a scale representation of at least one wing of a full size aircraft, wherein said at least one wing member includes at least one reinforcing member, and at least one body member operatively attached to said at least one wing member, wherein said at least one body member is constructed in vertical elevation being a scale representation of at least the nose and fuselage of the full size aircraft, said at least one body member has at least one tether attachment area with at least one tether hole positioned for attachment of a tether line, wherein said at least one tether attachment area is formed of an expanded rigid polystyrene plastic foam core, balsa wood outer reinforcement layers, and at least one tether hole reinforced with a plastic cylinder.

* * * * *